US010044089B2

(12) United States Patent
Huckfeldt et al.

(10) Patent No.: US 10,044,089 B2
(45) Date of Patent: Aug. 7, 2018

(54) UNDERWATER ANTENNA DEVICE WITH A NON-STATIONARY ANTENNA AND UNDERWATER VESSEL

(71) Applicant: ATLAS ELEKTRONIK GmbH, Bremen (DE)

(72) Inventors: Sonke Huckfeldt, Elmshorn (DE); Norbert Slotta, Stade (DE)

(73) Assignee: ATLAS ELEKTRONIK GmbH, Bremen (DE)

( * ) Notice: Subject to any disclaimer, the term of this patent is extended or adjusted under 35 U.S.C. 154(b) by 196 days.

(21) Appl. No.: 14/404,101

(22) PCT Filed: Jan. 30, 2013

(86) PCT No.: PCT/DE2013/100032

§ 371 (c)(1),
(2) Date: Nov. 26, 2014

(87) PCT Pub. No.: WO2013/185749

PCT Pub. Date: Dec. 19, 2013

(65) Prior Publication Data

US 2015/0102967 A1 Apr. 16, 2015

(30) Foreign Application Priority Data

Jun. 16, 2012 (DE) ..... 10 2012 011 985
Jun. 16, 2012 (DE) ..... 10 2012 011 987

(51) Int. Cl.
*H01Q 1/04* (2006.01)
*H01Q 1/08* (2006.01)
(Continued)

(52) U.S. Cl.
CPC ..... *H01Q 1/04* (2013.01); *B65H 75/42* (2013.01); *B65H 75/4405* (2013.01);
(Continued)

(58) Field of Classification Search
CPC ..... H01Q 1/04; H01Q 1/087; H01Q 1/10; H01Q 1/103; H01Q 1/34
(Continued)

(56) References Cited

U.S. PATENT DOCUMENTS 2,396,463 A * 3/1946 Hammond, Jr. ..... F41G 7/00 114/21.2
3,158,865 A 11/1964 Mccorkle
(Continued)

FOREIGN PATENT DOCUMENTS

DE 1766854 9/1971
DE 3841552 6/1990
(Continued)

*Primary Examiner* — Daniel J Munoz
(74) *Attorney, Agent, or Firm* — Pearl Cohen Zedek Latzer Baratz LLP

(57) ABSTRACT

The invention relates to an underwater antenna device with a nonstationary antenna, an extension mechanism and a repositioning mechanism, wherein an extending force can be applied in a direction of the extending force by the extension mechanism of the antenna and an opposing force can be applied in a direction of the opposing force, in the opposite direction to the extending force by the repositioning mechanism of the antenna, characterized in that the repositioning mechanism or a part of the repositioning mechanism is designed as selectively nonstationary, so that, by selected changes to the position, the antenna can be positioned in a retracted position, an extended position or an intermediate position.

19 Claims, 8 Drawing Sheets

(51) Int. Cl.

| | |
|---|---|
| ***H01Q 1/10*** | (2006.01) |
| ***H01Q 1/34*** | (2006.01) |
| ***B65H 75/44*** | (2006.01) |
| ***B65H 75/42*** | (2006.01) |
| *B63G 8/38* | (2006.01) |

(52) U.S. Cl.
CPC ..... *B65H 75/4415* (2013.01); *B65H 75/4484* (2013.01); *H01Q 1/087* (2013.01); *H01Q 1/10* (2013.01); *H01Q 1/103* (2013.01); *H01Q 1/34* (2013.01); *B63G 8/38* (2013.01)

(58) Field of Classification Search
USPC ..... 343/709, 710, 719, 707, 877
See application file for complete search history.

(56) References Cited

U.S. PATENT DOCUMENTS

| | | | | |
|---|---|---|---|---|
| 4,209,792 | A | 6/1980 | Bridges | |
| 4,334,226 | A * | 6/1982 | Eguchi | G01S 3/42 342/355 |
| 5,132,696 | A * | 7/1992 | Cobb | H01Q 1/081 343/709 |
| 6,392,606 | B1 * | 5/2002 | French | G01S 19/36 343/709 |
| 7,472,665 | B2 | 1/2009 | Bertin | |
| 2002/0075193 | A1 | 6/2002 | French et al. | |
| 2010/0146873 | A1 * | 6/2010 | Keller | E04H 12/182 52/111 |
| 2011/0132633 | A1 * | 6/2011 | Montena | H01B 11/1869 174/28 |

FOREIGN PATENT DOCUMENTS

| | | |
|---|---|---|
| DE | 10027829 | 1/2002 |
| DE | 102009040152 | 11/2010 |
| EP | 1739006 | 1/2007 |
| FR | 2851339 | 8/2004 |
| GB | 1191598 | 5/1970 |
| WO | WO 2004039666 | 5/2004 |

* cited by examiner

UNDERWATER ANTENNA DEVICE WITH A NON-STATIONARY ANTENNA AND UNDERWATER VESSEL

CROSS-REFERENCE TO RELATED APPLICATIONS

This application is a National Phase Application of PCT International Application No. PCT/DE2013/100032, entitled "UNDERWATER ANTENNA APPARATUS COMPRISING A NON-STATIONARY ANTENNA AND UNDERWATER VESSEL", International Filing Date Jan. 30, 2013, published on Dec. 19, 2013 as International Publication No. WO 2013/185749, which in turn claims priority from German Patent Application No. 10 2012 011 987.9, filed Jun. 16, 2012 and German Patent Application No. 10 2012 011 985.2, filed Jun. 16, 2012, all of which are incorporated herein by reference in their entirety.

FIELD OF THE INVENTION

The invention relates to an underwater antenna device with a nonstationary antenna, an extension mechanism and a repositioning mechanism, wherein an extending force can be applied by the extension mechanism of the antenna in a direction of extension and a force counteracting the extending force can be applied in an opposing direction of force by the repositioning mechanism of the antenna, and an underwater vessel, which has an underwater antenna device.

BACKGROUND

Guiding torpedoes by means of a data exchange via fiber-optic cable en route to a target is known. For this, both the torpedo and the launcher of the torpedo, for example, a submarine, each have a coil of fiber-optic cable, from which the optic fiber is uncoiled as the torpedo moves or the submarine travels.

The ranges of this type of cable-guided torpedo are limited. OE 10 2009 040152 A1 discloses a (remotely) controlled torpedo with an increased range, which has an antenna section with an extendible radio antenna and a radio communications devices for transmitting and/or receiving. The radio antenna of the known torpedo, for example, is designed like a telescope and is of such a length as to be able to reach the surface of the water when the torpedo is submerged, in order to thereby establish a communications link or at least to be able to receive data from the satellite-based navigation system. The torpedo is guided to the target area by means of the radio antenna and the positioning data received via the radio antenna. The torpedo can also relay current data and/or data recorded beforehand to the control center via the radio antenna. As a result, the control center receives precise data regarding the torpedo close to its target, which is useful for clarifying its position for the control center. The torpedo is also able to receive, e.g. new target data or deactivation commands via the communications link.

To make contact via the radio antenna, the torpedo navigates near the surface of the water and extends the radio antenna to such an extent that it is located in the area above water and can establish a radio link unimpeded by the water. Due to the telescopic design of the radio antenna, a considerably increased extended length of the radio antenna can be provided compared to the caliber of the torpedo so that the torpedo is prevented from breaching the surface of the water. At the same time, establishing contact by extending the radio antenna is a sensitive operation, in which the torpedo must avoid revealing itself or being able to be located as it approaches the target by extending and retracting the radio antenna in the water near the surface. An extending and retracting of the radio antenna as noiseless as possible must also be ensured after several actuations of the radio antenna. The radio antenna must also be able to be retracted and extended failure-free after the torpedo has been stored for longer periods.

SUMMARY

The present invention is based on the object to improve the prior art and, in particular, with a compact torpedo design, to guarantee a reliable retraction and extension of the radio antenna.

The object is solved by an underwater antenna device with a nonstationary antenna, an extension mechanism and a repositioning mechanism, wherein an extending force can be applied by the extension mechanism of the antenna in a direction of extension and a force counteracting the extending force can be applied in an opposing direction of force by the repositioning mechanism of the antenna, wherein the repositioning mechanism or a part of the repositioning mechanism is designed to be selectively nonstationary so that by selectively changing its location, the antenna can be positioned in a retracted position, an extended position or an intermediate position.

Thus, an underwater antenna device can be provided for a manned or unmanned underwater vessel, for which the disadvantages of the prior art described above are eliminated.

In addition, in the present case, it can be guaranteed that the antenna can be retracted and extended multiple times. As well, the retraction and extension can be exceedingly noiseless.

The concepts are explained in the following:

The "underwater antenna device" has been specifically designed in order to be able to meet the special demands of the particular conditions under water. In particular, the antenna is corrosion-resistant and waterproof, so that a penetration of (salt) water is also precluded over longer periods.

A "nonstationary antenna" is an antenna whose positioning, defined horizontally and/or vertically, can be changed. A simple implementation can take place via an antenna arranged on a swiveling joint, wherein the joint. The antenna can have an antenna dish to amplify the signals.

The "extension mechanism" applies an "extending force" to the antenna in an "extension direction" so that the antenna undergoes a change in location. In the example of the antenna arranged on a joint, this can take place by a compression spring or a tension spring applying an extending force on the antenna. The direction of the extension can be described mathematically as the respectively effective force vector.

The "repositioning mechanism" is a mechanism separate from the extension mechanism, which, independently of the extension mechanism, applies a "counteracting force" in a "direction of counteracting force" on the antenna. One simple realization, for example, is a tie rod, which locks or movably resists the tension spring or compression spring of the extension mechanism, so that the position of the antenna comes about due to the combination of the extending force and the counteracting force.

Due to the magnitude and direction of the counteracting force and the magnitude and direction of the extending force, the antenna is "selectively nonstationary", so that a desired position can be attained by selection or adjustment.

Using this selective "positioning", the possible individual positions of the antenna such as the "retracted position", the "intermediate position" and/or the "extended position" can be achieved. The retracted position represents, in particular, the hydrodynamically most useful, in particular, most compact form of the underwater antenna device. The extended position is, in particular, the position, in which a transmission and reception takes place by means of the antenna. The intermediate position can represent a position between each of the two extreme positions (retracted position and extended position).

In one embodiment, the direction of the extending force and the direction of the opposing force are arranged parallel to one another or form an angle with an angular value greater than 0° or greater than 5° or greater than 15° or greater than 45° or greater than 65° or greater than 90°.

Hence, alternatives can be provided. In particular, with the parallel arrangement, an absolutely vertical or absolutely horizontal retraction and extension can be realized. The angular values can be obtained, in particular, by attaching the repositioning mechanism externally on the antenna. The corresponding angles come about depending on the position of the attachment.

In the present case, the angular values are indicated in degrees.

In order to provide a particularly suitable realization of the repositioning mechanism, the repositioning mechanism can have a cable drum with a cable and the cable, in particular, can be attached to the antenna, and the cable drum, in particular, can be attached to a fixed location on the underwater antenna device and a drive unit can be attached to the cable drum, by which, in particular, a rotation can be applied to the cable, so that the cable is wound or unwound by the rotation.

The selective change in location can be particularly easily realized by winding or unwinding the cable. As a result, this is advantageous, in particular, since the length of the cable can constitute a direct proportionality to the positioning of the antenna and hence to the retracted position, the intermediate position and the extended position. In particular, by the use of the cable, the direction of the opposing force can be selectively determined and/or modified by rollers and rerouting points.

The use of the cable drum, in particular, is therefore advantageous since, as a result, a very compact and hence effective repositioning mechanism can be provided.

A "cable drum", also referred to as a cable winch, is essentially a device, with which something can be pulled with the aid of a cable. Here, the cable is generally wound onto a cylindrical drum driven by a motor or using muscle power.

The "cable" (winch cable) can be a conventional cable, wherein, here, stainless steel cables or plasma cables made from "ultra high molecular weight" polyethylene (PE-UHMW), for example, are used.

The tensile force of the cable drum can be increased by the use of a pulley.

The "fixed location" can be an immovable element of the underwater antenna device or can be located on the body, on which the underwater antenna device is mounted. On the whole, it must be guaranteed that the effect of the extending force can be controlled by means of the opposing force via a counter point.

By means of the "drive unit", the cable drum can be operated in a controlled and/or adjusted manner to rotate forwards or backwards, so that the cable is wound or unwound and hence, the position of the antenna is controlled or adjusted.

To be able to provide a particularly exact control or regulation with a high repeat accuracy and an underwater antenna device not susceptible to wear, the drive unit can have a multiphase motor and/or the cable drum can have a friction clutch.

A "friction clutch" is, in particular, an automatic torque-shifting safety coupling, which protects the antenna, the drive unit and other parts of the underwater antenna device from damage.

A "multiphase motor" is a linear motor or a synchronous motor, in which the rotor (the rotating part of the motor with the shaft) can be turned by a controlled electromagnetic field of the stator coils (non-rotating part of the motor), rotating in stages by a minimal angle (step) or a multiple of this.

In one embodiment in this respect, the repositioning mechanism has a drive shaft, on which the cable drum, in particular, is arranged so as to be movable, and a synchronizing element, wherein the cable drum, drive shaft and synchronizing element are arranged so that a cable lead-off point is guided to a level with the antenna.

Consequently, lateral displacements of force due to the uncoiling or coiling of the cable drum can be reduced or avoided. On the one hand, the cable drum can be repositioned on the drive shaft in accordance with the position of the cable and, on the other hand, the cable can be precisely guided by being deflected, for example, through a fixed loop.

The controlled repositioning of the cable drum on the drive shaft can for example take place by means of a linear motor, which determines the position of the cable via a sensor system such as a camera and associated electronic evaluation, and corrects it accordingly.

The "cable lead-off point" is, in particular, the location at which the cable is positioned in direct alignment with the antenna.

To provide a particularly advantageous antenna for the underwater antenna device, the antenna can be designed as a telescopic antenna with at least a first section and a second section, which is displaceable thereto and, in particular, only form one section of the radio antenna.

Thus, in particular, a vertically extendable antenna can be provided, in which only that portion of the antenna (radio antenna), which is relevant to the transmission or reception of signals, protrudes from the water. In addition, it is difficult for underwater vessels to detect or recognize an antenna of this type.

The two "sections" can be designed so that they can be moved together or into one another. Thus, in particular, one section is formed as a fixed external telescopic tube with an elliptic, circular or rectangular cross-section, wherein this section then supports the actual radio antenna.

In a further embodiment, the telescopic antenna has a third section, a fourth section, a fifth section or further sections. Hence, the telescopic antenna can be extended in accordance with the additional sections.

A signal and/or energy supply for the radio antenna can be arranged within the telescopic antenna in order to guarantee a safe operation of the antenna. Signal processing and hence an electronic unit can also be arranged in the antenna.

In particular, the ambient medium, water, cannot affect the power supply or the signal supply and the cost of shielding the components is reduced accordingly.

The "power supply" can include, in particular, a voltage supply and hence an electricity supply for the antenna or the electronic unit. This is particularly advantageous for active antennae.

In its simplest form, the "signal supply" comprises a cable or a coaxial cable, through which the signals to be transmitted or received are conducted.

In a further embodiment, the cable is fed through the telescopic antenna. Hence, controlling the direction of the extending force and the opposing force in parallel can be realized. This results, in particular, in effective extending and retracting of a vertical telescopic antenna.

To apply an extending force in the direction of the extending force to the antenna, the extension mechanism can have a hydraulic device (referred to in the following as hydraulic solution) and/or a pneumatic device (referred to in the following as pneumatic solution) and/or an electric motor (referred to in the following as electric motor solution), which apply the extending force to the antenna permanently or connectably.

Thus, effective and small designs can be provided for the underwater antenna device.

In addition, components for controlling the pressure/force or for adjusting the pressure/force can be omitted since only the pressure must be supplied, which places the antenna in the direction of extension without an opposing force. Only simple switches to engage or disengage the appropriate pressure or the appropriate force can be provided. Note that there is essentially the following functional correlation between the pressure P and force F: $P=F/A$, where A describes the surface area.

A piston inside the telescopic antenna, which applies the extending force to the antenna, can be operated both via the hydraulic system and via the electric motor.

The extending force can be applied to the antenna by means of the pneumatic system without using a piston, wherein, in particular, a pressure is applied to the cavity of the telescopic antenna.

Where the volume of the cavity is reduced by the opposing force (with the hydraulic solution or pneumatic solution), a one-way valve can channel the pressure outside, for example into a reservoir.

In a further embodiment, the underwater antenna device has an antenna position sensor.

With this, the position of the antenna can be determined both directly and indirectly. In direct determination, the position of the antenna can be determined by means of a distance meter or in an optical manner. In indirect determination, the step data of the cable pulley and of the associated multiphase motor, for example, can be analyzed.

In a further aspect of the invention, the object is solved by an underwater vessel, in particular, an underwater projectile, which has an underwater antenna device as described above.

Thus, a reliable extendable and retractable antenna can be provided.

General aspects of the invention will be clarified below, wherein the pneumatic solution, in particular, will be discussed, wherein the aspects, which do not particularly apply to the pneumatic solution, also apply to the hydraulic solution and the electric motor solution:

Using a (pulling) cable, which is accommodated on a rotating, drivable cable drum, reliable and rapid retraction of the radio antenna via the pulling cable can be ensured with little space requirement.

The radio antenna can be extended pneumatically, on the other hand, via a pneumatically/hydraulically activated telescopic cylinder. Here, in particular, a permanent static pressure is applied to the telescopic cylinder, wherein the pulling cable holds the telescopic cylinder in the retracted position. Once the cable drum releases the pulling cable, the radio antenna/antenna is opened pneumatically due to the effect of the static pressure.

Due to the combination of a pneumatically/hydraulically initiated antenna extending movement and retraction by means of a pulling cable in accordance with the invention, a reliable and stably operational direction of operation can be provided for the radio antenna in the little installation space available in a torpedo or an antenna section of the torpedo.

Here, a telescopic cylinder is understood as, in particular, a component containing parallel multiple telescopic tubes, which, for example, extend under static telescopic cylinder is in the retracted position, the telescopic tubes are inserted into one another.

In the retracted position, the pulling cable can be wound onto the cable drum, so that the tensile force exerted on the pulling cable thereby is greater than or at least equal to the tensile force exerted by the pressure on the telescopic cylinder in the direction of opening.

In one embodiment of the invention, the telescopic cylinder comprises telescopic tubes inserted into each other, parallel to each other, which can be extended from a fixed external cylindrical tube, wherein the furthest extendable telescopic tube supports the radio antenna.

Here, for the hydraulic solution, the fixed external cylindrical tube is mounted pressure-proof in the housing of the torpedo or of the antenna section of the torpedo, so that static pressure builds up inside the cylindrical tube, by which the telescopic tubes are extended. The furthest extendable telescopic tube, which in one embodiment of the invention is the inner telescopic tube, supports the radio antenna, which can thus be extended out of the torpedo or the antenna section over the entire extension length of the telescopic cylinder.

The arrangement of a radio antenna on the extendable end of the telescopic cylinder can be advantageous if an antenna cable of the radio antenna runs in an internal space of the telescopic tubes. The internal conduction of the antenna cable can provide a high-quality signal transmission, so that fault-prone contacts between the cylindrical tubes, for example, slider contacts, can be dispensed with. The antenna cable is, advantageously, a high-frequency coaxial cable.

The design is compact if the cable drum for winding and unwinding the pulling cable is arranged on the inside of the telescopic tube, wherein the pulling cable runs through the telescopic tube. Here, the pulling cable is connected to the furthest extendable telescopic tube, i.e. preferably to the internal telescopic tube. Where the pulling cable is wound, therefore, the furthest extendable telescopic tube is drawn in first, wherein this telescopic tube takes the other telescopic tubes along with it.

In a further embodiment of the invention, the radio antenna is incorporated in a plate-shaped antenna support, which is connected to the furthest extendable telescopic tube and at least partially radially overlaps the further extendable telescopic tubes, whereby the pulling cable draws the antenna support in and takes this along with it due to its radially overlapping the other telescopic tubes. Accommodating the radio antenna in a plate-shaped antenna support can also have the advantage that the radio antenna can be designed to be very small, for example, as an antenna board or a patch-antenna, and can be connected to a receiver or a transmitter of the torpedo via the internal antenna cable.

Advantageously, at least the outer telescopic tube, which is guided in the fixed cylindrical tube, is designed with a larger cross-sectional length in the longitudinal direction of the torpedo than the cross-sectional width in the transverse direction of the torpedo, so that where there is a higher degree of rigidity, there is a comparatively small reference surface for the inward movement of the telescopic tube. When the radio antenna is extended, the outer telescopic tube is located in the water and is in flow fields in accordance with the speed of the torpedo, so that fluid mechanics forces have an affect on the telescopic cylinder. Due to the streamlined design of the cross-section of the outer telescopic tube with as narrow as possible a width, although with a large cross-sectional length, a high bending stiffness is achieved, wherein, at the same time, the flow resistance is reduced.

In further developments of the invention, the cross-section of the outer telescopic tube is designed with other streamlined cross-sections, for example, with an oval shape with a small cross-sectional width. Here, a cross-sectional design with two approximately parallel, even sections and rounded surfaces fore and aft in the longitudinal direction of the torpedo can be inserted.

The antenna cable can be designed as a coiled cable in a section of the interior, which is short when extended and extends under traction during the process extending the radio antenna. The coiled cable design also ensures a defined return of the antenna cable into the original position when the antenna is retracted. The coiled cable can be furnished with an anti-twist safeguard in order to counteract snagging and knotting of the coils of the coiled cable. The anti-twist safeguard is, for example, an elastic spring coil along the antenna cable.

In a further embodiment of the invention, the pulling cable runs inside the coils of the coiled cable. Thus, the pulling cable guides the coils of the coiled cable, so that jamming the antenna cable between the pulling cable and the telescopic tubes, in particular, when the telescopic cylinder is moving, can be avoided.

Advantageously, the cable drum can be driven in both directions of rotation by a drive unit, so that the telescopic cylinder is controlled by the effect of the extending force and is extendable as a function of the rotational movement of the drive unit or of the cable drum. The telescopic cylinder extends synchronously with the movement of the cable drum, since the constant tensile force prevents an uncontrollable, rapid extending movement in the pulling cable due to the pneumatic operation of the telescopic cylinder.

In a further development of the invention, the cable drum can be operated by means of a self-locking gear, whereby the cable drum can only be moved by activation via the drive unit since the self-retention of the gear teeth counteracts the movement of the gear due to the cable forces at the cable drum. Hence, an idle state of the cable drum is guaranteed if there is no propulsion and uncontrolled movement of the cable drum is precluded.

In another embodiment of the invention, the gear is a worm gear, whose self-locking thread enables a precise transfer of torque and the angle of rotation of the drive unit.

The self-locking gear protects the cable drum, in particular, against backturning due to the tensile force in the pulling cable if the telescopic cylinder is held in the retracted position using a prestressed pulling cable.

The prestress in the pulling cable can be achieved by winding a greater length of cable than the one that corresponds with the extension length of the telescopic cylinder when the telescopic cylinder is retracted.

In a further embodiment of the invention, a friction clutch is arranged between the drive unit and the cable drum. The friction clutch is a torque-limiting safety coupling. This opens under a certain tension in the pulling cable, where the nominal torque of the friction clutch has been reached, which triggers the friction clutch and disrupts the transmission of drive power.

The friction clutch can be a magnetic clutch, which is wear-free and also maintains its nominal torque after a longer period without operation. Thus, the magnetic clutch prevents the potential adhesion of the clutch linings occurring in mechanical friction clutches following longer periods of storage.

An underwater vessel provided with an underwater antenna device with a magnetic clutch in the drive train is therefore also immediately operational after a longer period. Due to the prestress, the pulling cable is kept taut in the retracted position of the telescopic cylinder, so that the unwound cable length can be precisely controlled and contact of the pulling cable with the inside wall of the telescopic cylinder can also be precluded.

The drive unit can have a multiphase motor, so that the angle (step) of the movement of the motor can be translated into the associated movement of the cable drum. Here, the multiphase motor can be activated over a predefined number of steps, which is equivalent to the designated cable length for extending the radio antenna. To retract the radio antenna, the multiphase motor is actuated in the opposite direction of rotation over a likewise determined number of steps, wherein the number of steps on retracting the radio antenna can be calibrated with the number of steps of the multiphase motor on extending the radio antenna.

The length of cable wound on retracting the radio antenna can be higher than the extension length of the telescopic cylinder by a certain amount, whereby component tolerances and variations in length of the pulling cable due to changed external conditions can be compensated for. The drive of the radio antenna can be continually adjusted, e.g., with the pneumatic solution, to pressure changes due to temperature or to lengthening due to the usage or age of the pulling cable, for example, due to friction or yield phenomena due to the tensile load, by winding and unwinding the constantly taut pulling cable.

The friction clutch can ensure the controllability of the extendable radio antenna via the cable length since the pulling cable is placed under tension on unwinding, although excessive tension is prevented by triggering the friction clutch. In this embodiment of the invention, the nominal torque of the friction clutch determines the cable length unwound by the cable drum during the unwinding process of the radio antenna. The nominal torque of the friction clutch is thus calibrated for the desired cable length on unwinding so that a tension in the pulling cable is given.

In one embodiment of the invention, the cable drum can be inserted onto a drive shaft so as to be longitudinally movable and is coupled with a synchronizing element, inserted so as to be longitudinally movable independently of the drive shaft, so that a cable lead-off from the cable drum is fed through at a fixed lead-off point at the level of the center of the telescopic cylinder. Thus, it can be ensured that, at any angular position of the cable drum, the pulling cable is positioned in the envisaged vertical position inside the telescopic cylinder during the operation of the cable drum.

Here, the lead-off point of the pulling cable is advantageously located in the center of the cross-section of the telescopic cylinder, so that the vertical feeding of the pulling cable is guaranteed. Repositioning the cable lead-off ensures that the unwound or wound cable length is precisely parallel to the rotation of the cable drum. The precision of the control of the unwound or wound cable length can be further improved if the pulling cable is accommodated in a cable groove running around the perimeter of the cable drum.

In particular, the synchronizing element works together with the drive shaft via a thread, which has the same gradient as a cable groove on the cable drum. The cable groove is a furrow running around the perimeter of the cable drum, in which the pulling cable is wound with a selected gradient.

If the synchronizing element and the thread of the drive shaft, onto which the synchronizing element is inserted, have the same gradient as the cable groove of the cable drum, then the cable drum inserted so as to be longitudinally movable is moved back and forth by the synchronizing element with the rotary movement of the drive shaft and, in the process, the cable lead-off is fed to the fixed lead-off point regardless of the position of the cable drum.

In the pneumatic solution, a pressure compartment of the telescopic cylinder is advantageously connected to a gas source, which supplies a gas under pressure. Here, the gas source can be designed so that a continuous static pressure acts on the telescopic cylinder during the operation of an underwater vessel. The pulling cable holds the telescopic cylinder in the retracted position (also referred to below as the closed position) against the pneumatic forces, wherein extending and retracting the radio antenna can be precisely controlled via the drive of the cable drum.

The pressure source can be a gas reservoir, in which compressed gas is stored, wherein the gas reservoir is connected to the pressure compartment via a pressure reducer unit. The gas for the pneumatic pressurization of the telescopic cylinder is provided in the gas reservoir under a higher pressure than the operational pressure, wherein the pressure reducer unit regulates the operational pressure. Due to the higher pressure in the gas reservoir, a gas volume can be fed in for a large number of opening processes of the radio antenna, such that the operational pressure in the pressure compartment is essentially kept constant. Here, an operational pressure of approximately 4.5 bar has proven to be advantageous.

In alternative embodiments of the invention, pressure sources other than a gas reservoir are provided, which temporarily supply gases by physical or chemical means and thereby create the pressure required to operate the telescopic cylinder.

In a further embodiment of the invention, the pressure compartment is connected to an equalizing tank. The compressed air for operating the telescopic cylinder is restored by the expansion tank due to the increase in the volume and comes into affect in the next extension of the radio antenna. Ventilation is not required, so that, aside from losses due to leakage, an operating volume of the operating gas is permanently available. Following a communications process, if necessary, the radio antenna must be supplied with a small volume of gas to compensate for potential losses due to leakage in the system, to maintain the envisaged operational pressure.

The telescopic cylinder can be connected in a pressure-resistant manner to an end housing of the torpedo, the inside of which is a part of the pressure compartment, wherein the cable drum in the end housing is arranged. As a result, the entire length of the pulling cable is located within the pressure compartment, so that the pressure compartment can be easily sealed. In addition, the cable drum can be arranged particularly near to the inner end of the telescopic cylinder, so that a compact design of the installation space available inside the torpedo is possible.

The end housing can have a pressure release valve, so that the end housing can be ventilated, for example, after performing an exercise with a torpedo. In addition, the pressure release valve allows the pressure compartment to be rinsed with a suitable medium, in order to remove moisture from the compartment and to enable longer storage of the torpedo.

The underwater antenna device with an extendable antenna according to the invention, in particular, can be incorporated in an underwater projectile constructed in sections, in particular, a torpedo, with little effort, so that the underwater projectile need not be completely reconstructed. In a further embodiment, the underwater antenna device for retracting and extending a radio antenna according to the invention is incorporated in an integrally constructed underwater vessel.

The current methods can be performed with the underwater antenna device represented in the present case.

A method for extending and retracting an antenna of a underwater vessel, in particular, of a torpedo, wherein the antenna is extended by an extending force and an opposing counterforce, wherein the counterforce is applied, in particular, by means of a pulling cable and the antenna is held in a retracted position, wherein a drive of a cable drum on extending and retracting the telescopic cylinder is controlled, so that the cable drum unwinds or winds a certain cable length of a pulling cable (also referred to as a cable).

In one embodiment in this respect, a greater cable length of the pulling cable (48) is wound on retracting the radio antenna than an extension length of the telescopic cylinder.

In addition, the drive of the cable drum is controlled by a friction clutch, wherein, on retracting the radio antenna, the pulling cable is wound until the friction clutch is triggered.

In a further embodiment, a shorter cable length of the pulling cable than the cable length of the pulling cable is unwound on extending the radio antenna until the friction clutch is triggered.

In addition, the cable length of the pulling cable to be unwound can be calibrated with the extension length of the telescopic cylinder and can be shorter than the extension length.

In a further embodiment, the cable drum is driven by means of a multiphase motor, wherein the cable length to be wound or unwound is controlled by the number of step angles of the multiphase motor.

On extending the antenna, the multiphase motor can also be actuated for the cable length to be unwound by means of a predetermined number of extension steps.

In a further embodiment, the step angles of the multiphase motor can be counted on retracting the antenna until the friction clutch is triggered and the numerical value ascertained thereby is factored into the determination of the number of extension steps for the cable length to be unwound in the following extension of the antenna.

As well, a predefined adaptation value can be deducted in determining the number of extension steps using the numerical value for the step angles on the previous retraction of the radio antenna.

In a further embodiment, the cable drum is driven by means of a self-locking gear.

The pulling cable can also be wound in a cable groove of the cable drum.

In a further embodiment, the cable drum can be inserted on a drive shaft so as to be longitudinally movable and a cable lead-off of the cable drum can be fed through a synchronizing element (62) to a fixed lead-off point at the level of the telescopic cylinder.

In addition, the synchronizing element can work together with the drive shaft via an adjustment thread, which has the same gradient as the cable groove of the cable drum.

BRIEF DESCRIPTION OF THE DRAWINGS

Further advantageous embodiments will emerge as a result of the subclaims and of the exemplary embodiments outlined in more detail with reference to the drawings. In the drawings:

DETAILED DESCRIPTION

Figure 1:
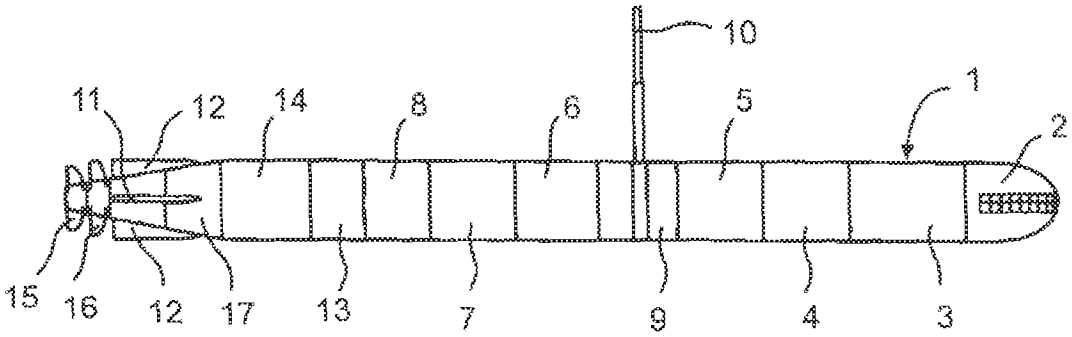
FIG. 1 is a lateral view of a torpedo formed in sections.
Figure 2:
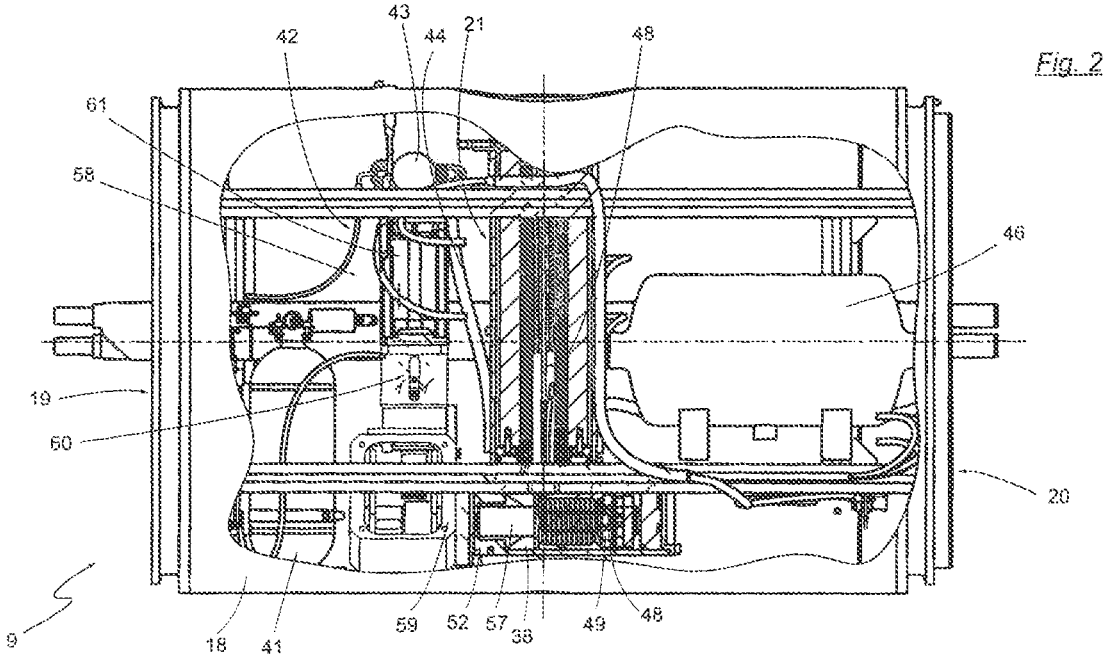
FIG. 2 is a partially cutaway lateral view of an antenna section of a torpedo according to FIG. 1.

FIG. 1 shows a schematic representation of a torpedo 1 designed in sections. The bow of the torpedo 1 is formed by a sonar head 2, which has a torpedo sonar to reconnoiter the nearer surroundings of the torpedo 1. A section 3 has an explosive charge. Alternately, this section, as an exercise section, is provided with devices used to be able to find and recover the torpedo 1 following an exercise. The torpedo 1 also incorporates multiple battery sections 4, 5, 6, 7, which are arranged centrally in the exemplary embodiment depicted in order to achieve as even as possible a weight distribution. In addition, the torpedo 1 incorporates a guidance section 8 and an antenna section 9, which is described in more detail below. The antenna section 9 has a radio antenna 10, which can be extended telescopically. Radio communications equipment for transmission and/or receiving is also arranged in the antenna section.

The antenna section 9 can be built into a torpedo 1 formed in sections with little difficulty, so that torpedoes need not be completely reconstructed. The antenna section 9 has an interface (not depicted), by means of which the positional data of the guidance section 8 obtained via the radio antenna 10 can be transferred. Taking the positional data obtained into consideration, the guidance section 8 generates control signals for controlling the rudder devices 11, 12 of the torpedo 1, for navigation and for determining the depth of the torpedo 1.

In addition, the torpedo 1 incorporates a communications management section 13 and a drive train section 14, in which a motor is arranged for driving two opposed propellers 15, 16. The rudder devices 11, 12 are components of a rudder section 17. The antenna section 9 is described in more detail below by means of FIGS. 2 to 10. Here, in each instance, the same reference numerals are used for the same components in all of the figures.

The antenna section 9 comprises a torpedo housing 18 of the designated caliber of the torpedo 1. The respective adjacent sections of the torpedo 1 can be connected to the faces 19, 20. The antenna section 9 has a radio antenna 10, which can be extended by means of a pneumatically operated telescopic cylinder 21. Here, when the radio antenna 10 is in the retracted position, this is flush with the torpedo housing 18 and the radio antenna 10 is retracted across the surface of the torpedo housing 18, so that the radio antenna 10 does not affect the caliber of the torpedo.

The telescopic cylinder 21 comprises multiple telescopic tubes 22, 23, 24, 25, inserted parallel into one another, which are arranged in a radial direction in the antenna section 9. Here, the telescopic cylinder 21 is arranged in a radial direction relative to the torpedo 1 so that the telescopic tubes 22, 23, 24, 25 can be extended upwards in the designated orientation of the torpedo 1, i.e. in the direction of the surface of the water.

The telescopic tubes 22, 23, 24, 25 are incorporated in a fixed external cylindrical tube 26, which extends through an opening in the torpedo housing 18 inside the antenna section 9 and is introduced in a pressure-tight manner into the torpedo housing 18. For this purpose, a cup-shaped insert 27 with a tapered seating is inserted into the opening of the torpedo housing 18. A bearing support 28 is bolted to the insert 27, which has a friction bearing 29 for the outer telescopic tube 22 and is seated on the face of the cylindrical tube 26. The bearing support 28 is sealed with the insert 27 by means of a gasket 28*a*.

The inner cylindrical tube 25, which can be extended the furthest, supports a plate-shaped antenna support 30, in which the radio antenna 10 is incorporated. The radio antenna 10 is connected to a signal processing device (not depicted) via an antenna cable 31, which is fed through the antenna support 30. The antenna cable 31 runs through the interior 32 of the internal cylindrical tube 25.

The radio antenna 10 is arranged on the outside of the antenna support 30 and is, in particular, an antenna board. The radio antenna 10 is attached to the antenna support 30 with a mounting 32 under a casting compound 33 permeable to radio signals. The antenna support 30 is inserted into the inner telescopic tube 25 with a pin 39 and is fastened here, namely in the exemplary embodiment depicted, by means of a thread. The antenna support 30 overlaps the extendable telescopic tubes 22, 23, 24, 25 and thus, on retracting the telescopic cylinder 21, is positioned on the extended ends of the respective telescopic tubes 22, 23, 24, 25 in sequence and telescopes these.

Figure 6:
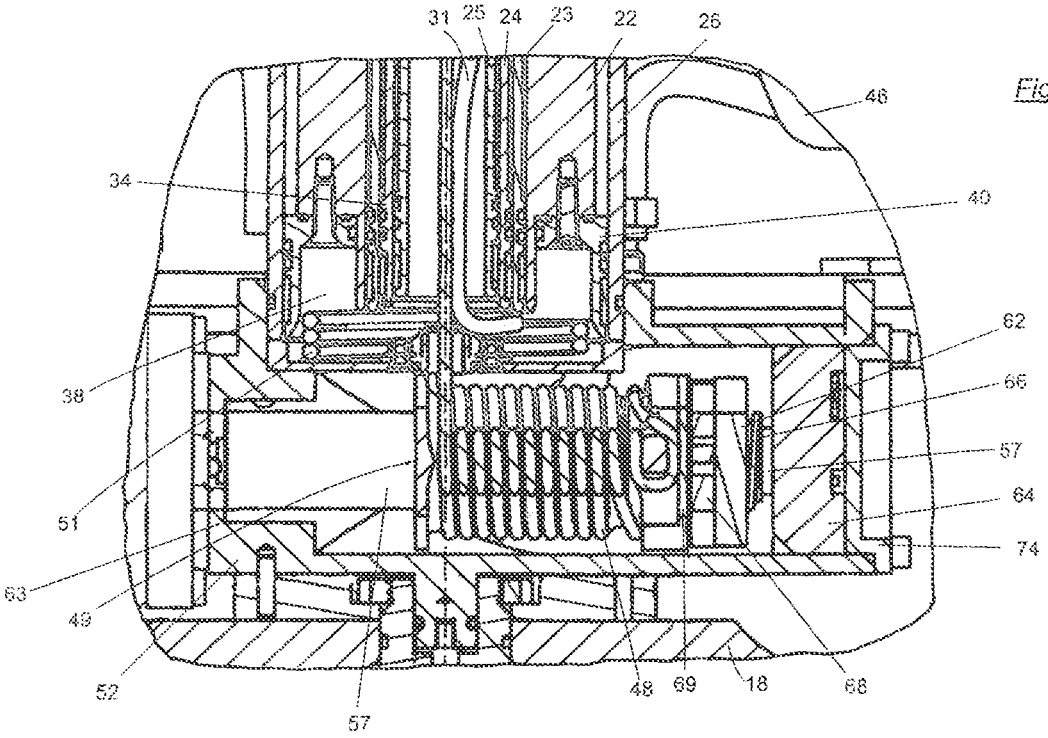
Figure 7:
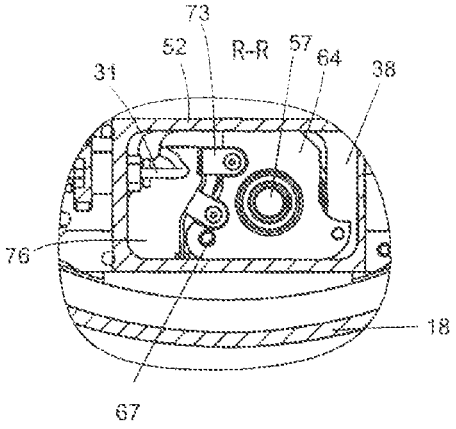
FIG. 7 is a cross-sectional view in the sectional plane R-R in FIG. 3.

The telescopic tubes 22, 23, 24, 25 are inserted into each other, wherein an end stop 34, facing radially outwards, is designed on the rear ends of each of the telescopic tubes 22, 23, 24, 25, from the direction of extension (FIG. 6). The end stops 34 can each be extended as far as an end stop on the inside, which is attached to the respective tube, encompassing the telescopic tube 22, 23, 24, 25 concerned. The end stops 34 limit the extension length of the telescopic cylinder 21 by a combination of the end stops, which extend in the direction of extension to the outer ends of the telescopic tubes 22, 23, 24, 25, inside the telescopic cylinder. These end stops are each formed by a spacer 35. Each spacer 35 is inserted into a notch, which is formed in the inside of the respective tube. An end stop is provided on the fixed cylindrical tube 26 for the outer extendable telescopic tube 22. The end stop for the outer extendable telescopic tube 22 is thus formed by the bearing support 28, which projects into the gap between the outer extendable telescopic tube 22 and the fixed cylindrical tube 26 to form the end stop.

The spacers 35 for the respective telescopic tubes 22, 23, 24, 25 are located at different intervals to the respective end stops of the inner ends of the telescopic tubes 22, 23, 24, 25, so that slightly different extension lengths are formed and jamming the telescopic tubes 22, 23, 24, 25 on retracting the radio antenna 10 is counteracted.

The telescopic tubes 22, 23, 24, 25 are each guided at both ends, wherein a friction bearing 36 is arranged inside at each forward end of the telescopic tubes 22, 23, 24, in the direction of extension. The outer telescopic tube 22 is guided in the friction bearing 29, which is inserted in the bearing support 28. The friction bearings 36 for the inner telescopic tubes 23, 24, 25 are designed as rotary friction bearing bushes.

In a further exemplary embodiment, bearing strips are provided as friction bearings. Each rear end of the extendable telescopic tubes 22, 23, 24, 25, in the direction of extension, is guided by means of the radial end stops 34, which extend to the inner surface of the adjacent tube and have guides.

The telescopic tubes 22, 23, 24, 25 are manufactured from a semi-finished product as turned parts, so that optimal wall thicknesses and precisely arranged notches for arranging the friction bearings 36 and the notches for the spacers 35 can be formed.

The telescopic cylinder 21 in the present exemplary embodiment comprises four concentrically arranged telescopic tubes 22, 23, 24, 25, wherein the inner three telescopic tubes 23, 24, 25 are designed with a circular cross-section. The outer telescopic tube 22, which is inserted in the fixed cylindrical tube 26, is designed with a greater cross-sectional length in the longitudinal direction of the torpedo 1 than a cross-sectional width in the transverse direction of the torpedo 1; cf. FIG. 4.

The outer telescopic tube 22 has an elongated cross-section with a greater length in the longitudinal direction of the torpedo than a cross-sectional width in the transverse direction of the torpedo. In the exemplary embodiment depicted, the outer telescopic tube 22 has an oval cross-section for this reason, with two parallel, even sides, which are connected by round faces. Thus, there is a high bending stiffness in the longitudinal direction of the torpedo with, at the same time, a reduced flow resistance, so that, when the telescopic antenna is extended, the fluid mechanics forces due to the flowing water, which affect the telescopic tube 22, are reduced. In further exemplary embodiments not depicted, the outer telescopic tube 22 is formed with streamlined cross-sections in other than a circular shape.

For storage of the outer telescopic tube 22 with a non-circular cross-section, the bearing support 28 attached to the torpedo housing 18 is formed with a corresponding, non-circular cross-section, wherein the friction bearing 29 of the bearing support 28 is formed as a bearing strip.

In an alternative exemplary embodiment, the friction bearing 29 is a component made from friction bearing material with a cross-section corresponding with that of the telescopic tube 22.

The pressure compartment 38 of the telescopic cylinder 21 is delimited by the pin 39 of the antenna support 30 and by a piston 40, designed in a circular ring-shape, which is attached at the inner end of the non-circular telescopic tube 22. The pressure compartment 38 thus has a pneumatic effective surface, which is formed by a circular partial area of the pin 39 and a circular partial area of the piston 40 of the external telescopic tube 22. The piston 40 seals the pressure compartment 38 against the fixed external tube 26 and, at the same time, forms an end stop, which combines with the end stop of the bearing support 28 and delimits the extension pathway of the outer telescopic tube 22.

The antenna section 9 also has a gas reservoir 41. In the exemplary embodiment, the gas reservoir 41 is a gas canister mounted in the antenna section 9, in which a compressed gas supply is provided. The gas reservoir 41 is connected to a pressure reducer unit 43 by means of a high-pressure line 42, which communicates with the pressure compartment 38 by means of a low-pressure line 44. The high-pressure line 42 and the low-pressure line 44 are each connected to the pressure reducer unit 43 by means of a coupling 45. The pressure reducer unit 43 is adjusted to the designated operating pressure in the pressure compartment 38, with which the telescopic cylinder 21 is operated. The pressure reducer unit 43 reduces the comparatively high static pressure in the gas canister from, for example, 200 bar, to the operating pressure of, for example, 4.5 bar. Due to the high pressure in the gas canister, a large gas supply is provided for a large number of pneumatic operations of the telescopic cylinder 21.

In addition, an expansion tank 46 is connected at the pressure compartment 38, which tank substantially increases the volume of the pressure compartment 38. Thus, a compression on retracting the telescopic cylinder 21 results in a markedly lower increase in the operating pressure in the pressure compartment 38 than without this type of expansion tank 46. Due to the arrangement of the expansion tank 46, the increase in the operating pressure amounts to approximately 30%, wherein the compressed operating gas in the expansion tank 46 assists the extension of the radio antenna 10 on the next extension maneuver.

In other words, due to the arrangement of the expansion tank 46 and the associated substantial increase in the volume of the pressure compartment 38, there is an improved recovery of the working fluid.

The static pressure in the pressure compartment 38 affects both the ring-shaped surface of the piston 40 of the outer telescopic tube 22 and the circular effective surface of the pin 39 of the antenna support 30. Here, the ring-shaped effective surface of the piston 40 is greater than the effective surface of the antenna support 30, so that, on extending the telescopic cylinder 21, the external telescopic tube 22 is initially moved pneumatically. The telescopic tubes 23, 24 arranged in the center between the inner telescopic tube 25 and the outer telescopic tube 22 are each coupled to the respective adjacent telescopic tubes by means of adapter rings 47 and are taken along during the extension movement by means of the adapter rings 47. Here, the adapter rings 47 each engage in a notch at the free end of the respective telescopic tube 23, 24 and are engaged in an undercut at the respective externally adjacent telescopic tube 22, 23. Thus, on extending the telescopic cylinder 21, the outer telescopic tube 22 with the non-circular, streamlined cross-section is initially extended, wherein the three concentric inner telescopic tubes 23, 24, 25 are taken along. After the outer telescopic tube has reached its extension length, the static pressure in the pressure compartment 38 pushes the inner telescopic tube 25 out, which, in turn, after reaching its extension length, draws out the two remaining concentric telescopic tubes 23, 24 in succession.

The telescopic cylinder is held in the stationary retracted position against the static pressure in the pressure compartment by a pulling cable 48. The pulling cable 48 is a textile cable, which is mounted on the antenna support 30. A bolt 37 is provided in the pin 39 of the antenna support 30 to mount the pulling cable 48.

Due to the traction on the cable 48, the telescopic cylinder 21 is retracted from the extended position and held in the retracted position. For this purpose, the pulling cable 48 is wound onto a cable drum 49, which is arranged adjacent to the inner end of the telescopic cylinder 21, i.e. on that side of the telescopic cylinder 21, which faces its direction of extension.

The antenna cable 31 is designed as a coiled cable 50 in a section located inside the telescopic cylinder 21, whereby, on the one hand, it is ensured that the antenna cable 31 is ductile on extending the telescopic cylinder 21 by means of the provided extension length of the telescopic cylinder 21. On the other hand, the coiled cable 50 forms a guide for the pulling cable, which is guided by the surrounding coils of the coiled cable 50. The ductile extension length of the coiled cable 50 is thus adapted to the extension length of the three concentric, inner telescopic tubes 24, 25, 26. In addition, the antenna cable 31 is formed into a further coiled cable 51 in the area of the piston 40 of the outer, non-circular telescopic tube 22. The ductile length of the second coiled cable 51 of the antenna cable 31 is thus adjusted to the extension length of the outer telescopic tube 22. In order to prevent the formation of undesired loops in the antenna cable 31, the antenna cable in the area of the coiled cable 50, 51 is provided with an anti-twist safeguard. As an anti-twist safeguard, the antenna cable 31 in the area of the coiled cable 50, 51 is reinforced by being wrapped in an elastic wire or alternately with a coil spring.

The cable drum 49 is incorporated in an end housing 52, whose interior communicates with the pressure compartment 38, so that the pulling cable 48 is entirely incorporated in the pressure compartment 38. Elaborate pressure sealing of the pulling cable 48 can therefore be dispensed with. Together with the telescopic cylinder 21, the end housing 52 with the cable drum 49 arranged therein forms one structural unit, which is arranged in a cross-sectional plane of the torpedo 1, i.e. extending between the opposing wall sections of the torpedo housing 18. Here, the end housing 52 has a mounting pin 53, which is incorporated pressure-proof in the torpedo housing 18 using a greased O-ring 54. To adjust and seal the combined component consisting of the telescopic cylinder 21 and the end housing 52 precisely, an adjusting screw 55 and a special screw 56, accessible from outside the torpedo 1, are arranged on the mounting pin 53.

The cable drum 49 can be driven rotationally by means of a drive shaft 57, which is mounted in the end housing 52. The drive shaft 57 is a part of the drive train of a drive unit 58, which has a self-locking worm gear 59, a friction clutch 60 and an electric motor 61. The friction clutch 60 responds on reaching its nominal torque and disrupts the transmission of drive power from the motor 61 to the cable drum 49. The friction clutch 60 is designed as a magnetic coupling and comprises permanent magnets, whereby the friction clutch 60 is also immediately operational after a longer storage period, without adhesion of the components.

To extend the telescopic cylinder 21, the electric motor 61 drives the cable drum 49 in a rotational direction, which is delivered to the pulling cable 48 and, as a result, the telescopic cylinder 21 is pneumatically displaced by the operating pressure in the pressure compartment 38. To retract the telescopic cylinder 21, the electric motor 61 drives the cable drum 49 in the opposite rotational direction, so that the pulling cable is wound onto the cable drum 49 and thus the antenna support 30 is retracted.

The extension processes and the retraction processes of the radio antenna 10 are controlled by means of the activation of the drive unit 58, wherein the cable drum 49 is moved around such an angle of rotation by the drive unit 58, with which the quantity of the unwound cable length provided in the process corresponds. In the process, the self-locking worm gear 59 guarantees that the cable drum 49 is only able to move where there is a drive due to the motor.

The nominal torque of the friction clutch 60, with which the friction clutch 60 is triggered, is calibrated using the desired cable length of the pulling cable 48 on retracting the radio antenna 10. The nominal torque is selected or adjusted so that the friction clutch 60 responds on reaching a certain wound cable length of the pulling cable 48 on retracting the radio antenna 10 and disrupts the transmission of drive power. Thus, the winding of the pulling cable 48 on retracting the radio antenna 10 is stopped once the nominal torque of the friction clutch 60 has been reached.

The cable length to be unwound is controlled on extending the radio antenna by means of the motor 61. For this purpose, the motor 61 for driving the cable drum 49 is preferably designed as a multiphase motor. Here, the multiphase motor is moved by that number of steps, which corresponds with the circumferential angle of the cable drum 49 with the designated cable length. The cable length to be unwound, which is associated, for the multiphase motor, with the number of steps, is calibrated with the cable length to be unwound so that the pulling cable 48 is under tension in any operational position of the radio antenna 10. Advantageously, in the process, the motor 61 moves through a smaller number of steps than for winding the pulling cable 48, so that tension 25 always remains in the pulling cable on extending the radio antenna 10. Where there is a subsequent retraction maneuver, the friction clutch 60 guarantees winding up to the desired tension in the pulling cable 48.

The pulling cable 48 is arranged so as to be unrestricted and without coming into contact with the telescopic cylinder and is continuously held under tension by the cable drum 49 so that the antenna support 30 is held in the closed position and sealed. In order to continuously hold the pulling cable in the vertical direction, the cable drum 49 can be moved longitudinally on the drive shaft 57 and coupled to a synchronizing element 62, which will be outlined in more detail below, so that the cable lead-off of the cable drum is fed to a fixed lead-off point in the center of the telescopic cylinder 21.

Figure 3:
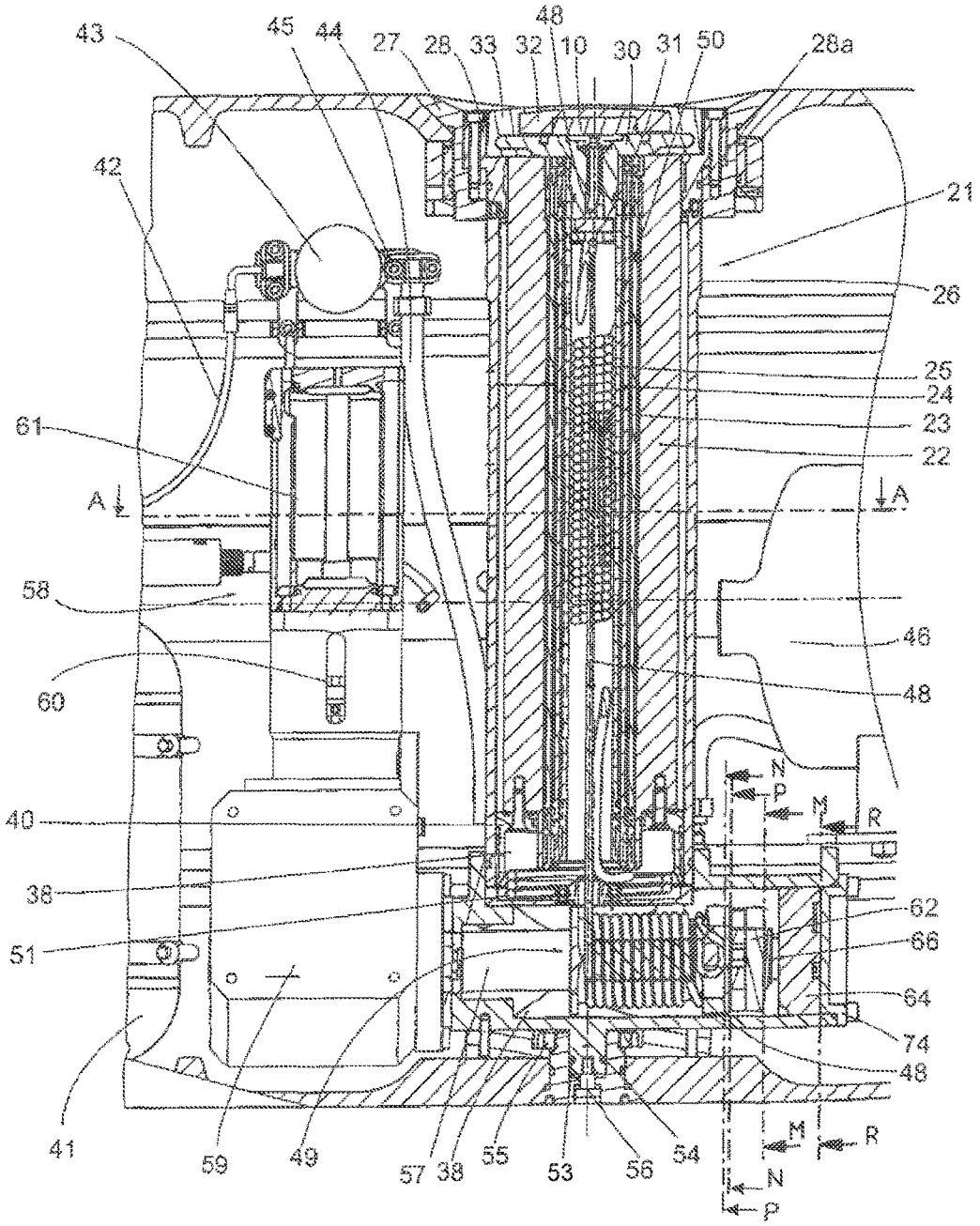
FIG. 3 is a magnified representation of a section of the antenna section according to FIG. 2.
Figure 4:
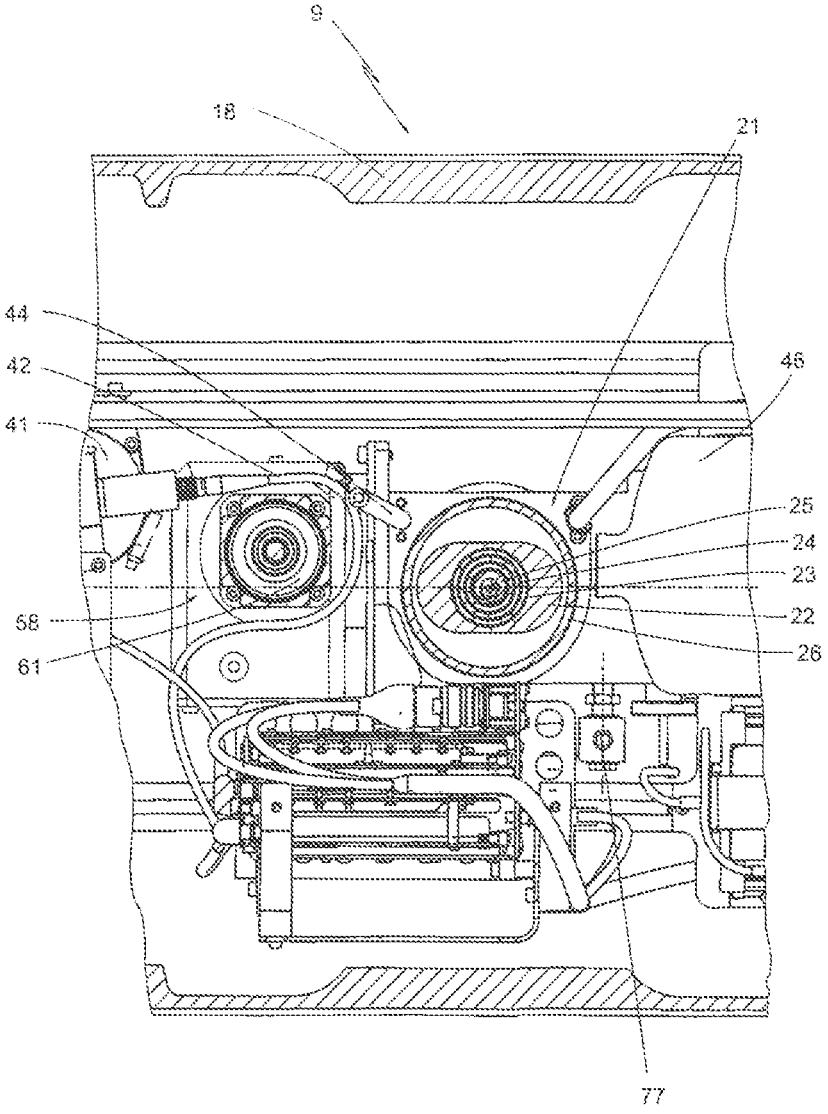
FIG. 4 is a cutaway view of the antenna section according to FIG. 2 in the sectional plane A-A in FIG. 3, FIGS. 5 and 6 are magnified representations of the opposing wall sections of the antenna section according to FIG. 3.
Figure 5:
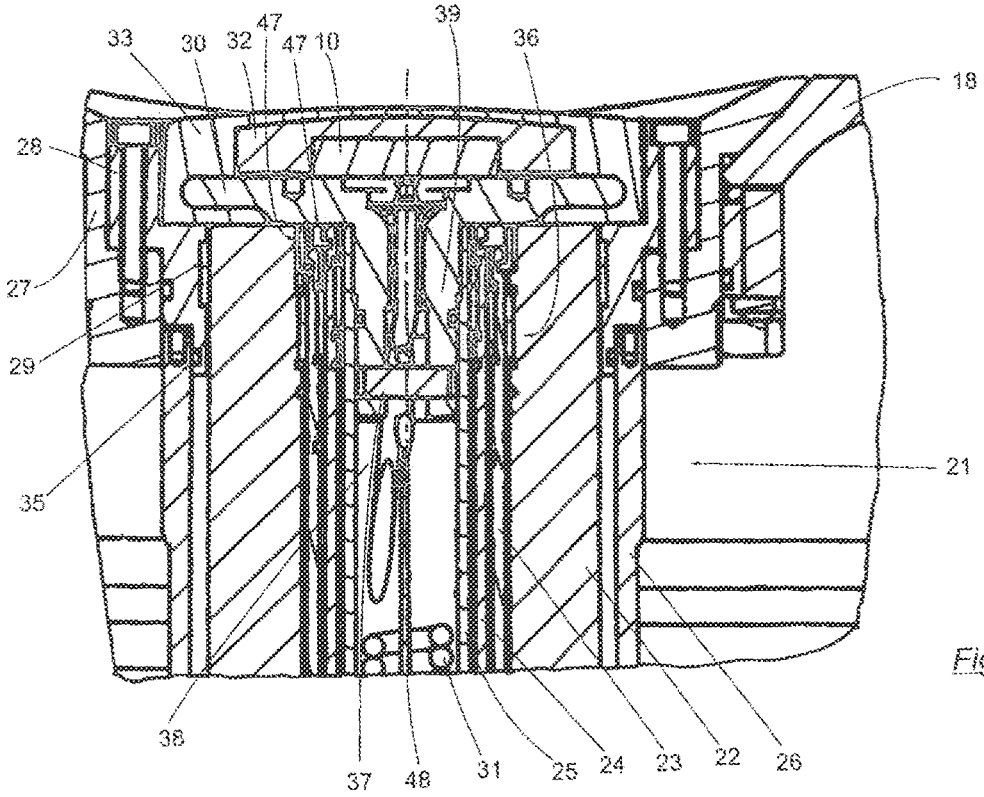

The mechanics affecting the cable drum 49 for feeding the cable lead-off is outlined below by reference to FIG. 3, 6 and the cutaway representation in FIGS. 7 to 10. The drive shaft 57 extends through the end housing 52 in the longitudinal direction of the torpedo 1 and is mounted on the forward walls 63, 64 of the end housing 52. Here, a forward wall 63 facing the drive unit 58 is formed as a single section in the end housing 52. A forward wall 64 is arranged on the side facing the end housing 52, which accommodates the free end of the drive shaft 57.

The cable drum 49 is arranged on the drive shaft 57 so as to be longitudinally movable. Here, an interlocking catch is provided so that the cable drum 49 can be driven so as to rotate by means of the drive shaft 57. This type of interlocking catch with simultaneous longitudinal moveability is provided in the present exemplary embodiment by a fitted key connection 65. Here, a key has been incorporated into the cable drum 49. A key notch adapted for the key has been provided in the drive shaft 57.

The cable drum 49 is provided with a surrounding cable groove, into which the pulling cable 48 is wound in a defined position. In each operational position of the radio antenna 10, the pulling cable 48 is under tension so that the pulling cable 48 is held securely in the cable groove.

The free end of the drive shaft 57 is provided with an adjustment thread 66 over a length, which is approximately equivalent to the length of the coil body of the cable drum 49. Here, the axial length of the section of the drive shaft 57 provided with the adjustment thread 66 is approximately equivalent to the range of movement of the cable drum 49 provided on feeding the cable lead-off. A disk-shaped synchronizing element 62 is arranged on the adjustment thread 66, which is fed in the direction of the drive shaft 57 so as to be longitudinally displaceable, independently of the cable drum 49.

The axial guide of the synchronizing element 62 is provided by a guide rail 67, which is fed through the end housing 52, parallel to the drive shaft 57. As can be seen in the plan view of the synchronizing element 62 in FIG. 9, the disk-shaped synchronizing element 62 conceals the sidewall of the cable drum 49 and is guided on the guide rail 67 by a radial lug 67*a*. Where the drive shaft 65 rotates, the rail-guided lug 67*a* on the guide rail 67 prevents a rotating synchronization of the synchronizing element 62, whereby the synchronizing element 62 is displaced by the adjustment thread 66 in the longitudinal direction of the drive shaft 57. Here, the displacement path of the synchronizing element 62 in the longitudinal direction of the drive shaft 57 corresponds precisely with the gradient of the adjustment thread 66.

The gradient of the adjustment thread 66 of the drive shaft 57 is equal to the gradient of the cable groove of the cable drum. With a full revolution of the drive shaft 57, the synchronizing element 62 is accordingly displaced via a path, which is equivalent to the gradient between the wound coils of the pulling cable 48.

The synchronizing element 62 affects the cable drum 49 arranged so as to be longitudinally displaceable in the direction of the longitudinal direction of the drive shaft 57 and thus feeding the cable lead-off of the cable drum 49 effectuates its guidance accordingly on the adjustment thread 66 when the drive shaft 57 rotates.

Figure 8:
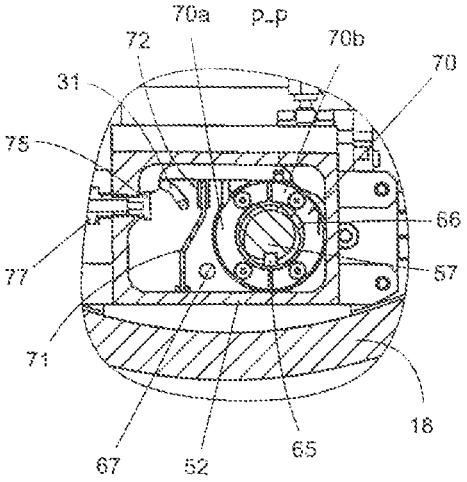
FIG. 8 is a cross-sectional view in the sectional plane P-P in FIG. 3.
Figure 10:
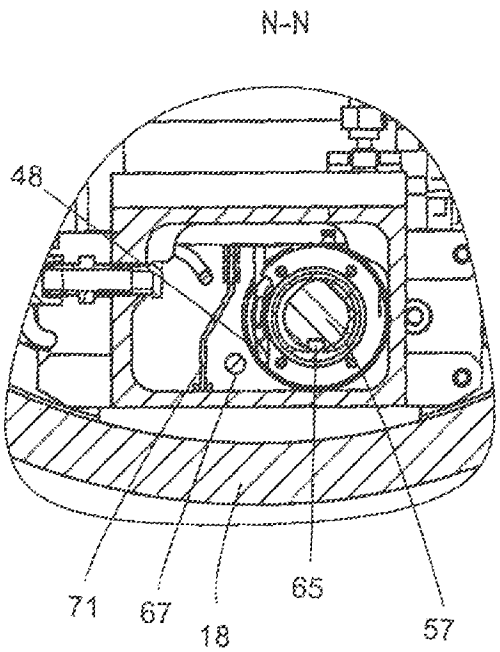
FIG. 10 is a cross-sectional view in the sectional plane N-N in FIG. 3.
Figure 9:
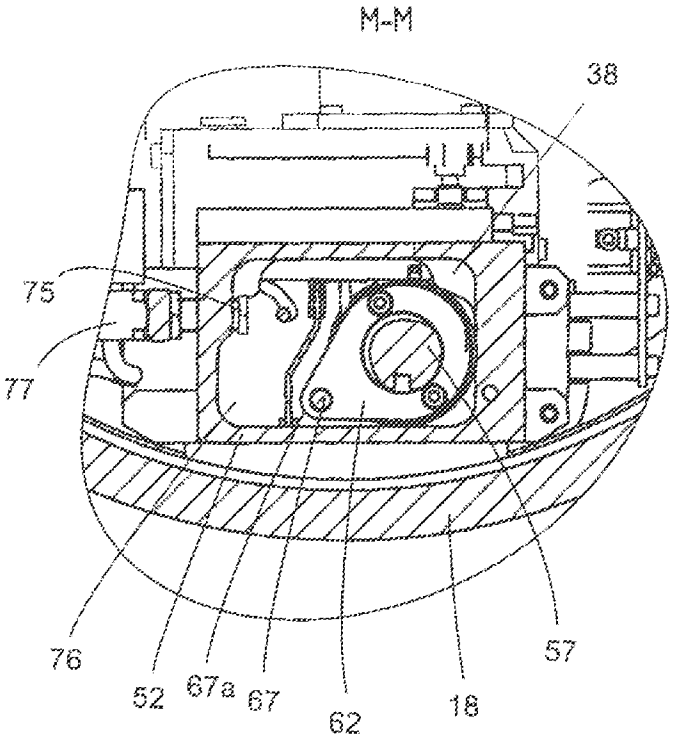
FIG. 9 is a cross-sectional view in the sectional plane M-M in FIG. 3.

In order to enable a drawing movement on winding the pulling cable 48 on the cable drum 49 for the synchronizing element 62, the synchronizing element 62 has an axial catch 68, which extends to near the facing side wall 69 of the cable drum 49. The axial catch 68 is kinematically connected to the side wall of the drum 69 by means of a coupling plate 70. The coupling plate 70 is constructed in two sections, with two approximately semicircular segments 70*a*, 70*b* (FIG. 8). The plate segments 70*a*, 70*b* are each attached to the cable drum 49 by means of bolt or rivet connections.

The inner radius of the plate segments 70*a*, 70*b*, which determines the diameter of the coupling plate 70 when the plate segments 70*a*, 70*b* are assembled, has a greater diameter than the drive shaft 57, so that the coupling plate 70 can be displaced in the longitudinal direction of the drive shaft 57 without intruding in the adjustment thread 66. The two-part coupling plate 70 can be easily mounted on the cable drum 49, by placing the plate segments 70*a*, 70*b* in the gap between the sidewall of the drum 69 and the catch 68, around the drive shaft 57 and fixing these to the sidewall of the drum 69.

A partition plate 71 is arranged in the end housing 52 in the longitudinal direction of the drive shaft 57, which separates the part of the end housing 52, in which the cable drum 49 is movably arranged, from the rest of the end housing 52. The partition plate 71 is inserted in guides 72, which are formed on each opposing section of the wall of the end housing 52. To attach the partition plate 71, brackets 73 are provided in the area of the front wall 64, in which the drive shaft 57 is mounted, which are mounted on the front wall 64.

In the exemplary embodiment depicted, the front wall 64, in which the drive shaft 57 is mounted, conceals the part of the pressure compartment 38 with the cable drum 49 arranged therein. The end housing 52 is sealed in a pressure-tight manner by a seal wall 74, which conceals the entire cross-section of the end housing 52.

The seal wall 74 is mounted so as to be detachable, so that the interior of the end housing 52 is accessible. Thus, a cable lead-through 75 is accessible, which is arranged in the subspace 76 of the end housing 52 on the other side of the cable drum 49. The cable lead-through 75 accommodates the antenna cable 31 and is sealed to the pressure compartment 38.

The pressure compartment of the telescopic cylinder 21 can be ventilated by means of a pressure release valve 77, so that moisture can be discharged. Ventilating the pressure compartment is advantageous, for example, immediately after assembling the antenna section 9, in order to discharge moisture or after testing the torpedo 1, in order to reduce the increased operating pressure in the pressure compartment due to multiple activations of the antenna, if required. In normal operation of the torpedo 1, ventilation of the pressure compartment is not required or desired. The pressure release valve 77 is activated, for example, after test firing in order to depressurize the system. In this way, hazards which could come about due to the torpedo being under pressure after the end of an exercise/test firing, such as a tear in the textile cable, are reliably precluded. The hazard to divers is also precluded by equalizing the pressure via the pressure release valve 77.

All characteristics in the foregoing description and referred to in the claims can be applied in accordance with the invention, both individually and in any combination with one another, in particular, essential characteristics can be adapted to the hydraulic solution or the electric motor solution. The disclosure of the invention is therefore not limited to the combinations of characteristics described or claimed. Rather, all combinations of individual characteristics should be viewed as having been disclosed.

The invention claimed is:

1. An underwater antenna device comprising a nonstationary antenna, an extension mechanism and a repositioning mechanism separate from the extension mechanism, wherein the extension mechanism is arranged to apply an extending force to the antenna and the repositioning mechanism is arranged to apply an opposing force to the antenna counteracting the extending force, wherein the repositioning mechanism or a part of the repositioning mechanism is movable, so that by selectively changing a position of the repositioning mechanism the antenna can be positioned in a retracted position, an extended position or an intermediate position due to a combination of the extending force and the opposing force, wherein the antenna is extendable by a pneumatically activated telescopic cylinder, which is held by a pulling cable in a retracted position and comprises a pressure compartment, wherein the pulling cable is wound onto a cable drum having a drive unit configured to control the extension and repositioning of the telescopic cylinder, and the pressure compartment is connected to an expansion tank configured to assist the extension of the antenna.

2. The underwater antenna device in accordance with claim 1, wherein the direction of the extending force and the direction of the opposing force are parallel to one another or form an angle with an angle value greater than 0°.

3. The underwater antenna device in accordance with claim 1, wherein the repositioning mechanism comprises the cable drum with the pulling cable arranged at a fixed location of the underwater antenna device at the antenna and the cable drum, and the drive unit is attached to the cable drum, arranged to apply a rotation to the cable drum, so that winding or unwinding of the pulling cable takes place by means of the rotation.

4. The underwater antenna device in accordance with claim 3, wherein the drive unit comprises a multiphase motor.

5. The underwater antenna device in accordance with claim 3, wherein the repositioning mechanism comprises a drive shaft, on which the cable drum is arranged so as to be movable, and a synchronizing element, wherein the cable drum, the drive shaft and the synchronizing element are arranged so that a cable lead-off point is at a level with the antenna, so that the pulling cable is positioned in direct alignment with the antenna.

6. The underwater antenna device in accordance with claim 3, wherein the pulling cable is guided inside the telescopic antenna.

7. The underwater antenna device in accordance with claim 1, wherein the antenna is a telescopic antenna comprising at least a first and second telescope sections and only one of said sections forms a radio antenna.

8. The underwater antenna device in accordance with claim 7, wherein the telescopic antenna additionally comprises third, fourth, and a fifth telescope sections.

9. The underwater antenna device in accordance with claim 7, wherein a signal and/or energy supply for the radio antenna is arranged within the telescopic antenna.

10. The underwater antenna device in accordance with claim 1, wherein the extension mechanism permanently or connectably applies the extending force to the antenna and wherein the extension mechanism comprises a device selected from the group consisting of: a hydraulic device and a pneumatic device and an electric motor.

11. The underwater antenna device in accordance with claim 1, comprising an antenna position sensor.

12. An underwater vessel which has an underwater antenna device in accordance with claim 1.

13. The underwater antenna device in accordance with claim 1, wherein the direction of the extending force and the direction of the opposing force form an angle with an angle value greater than 5°.

14. The underwater antenna device in accordance with claim 1, wherein the direction of the extending force and the direction of the opposing force form an angle with an angle value greater than 15°.

15. The underwater antenna device in accordance with claim 1, wherein the direction of the extending force and the direction of the opposing force form an angle with an angle value greater than 45°.

16. The underwater antenna device in accordance with claim 1, wherein the direction of the extending force and the direction of the opposing force form an angle with an angle value greater than 65°.

17. The underwater antenna device in accordance with claim 1, wherein the direction of the extending force and the direction of the opposing force form an angle with an angle value greater than 90°.

18. The underwater antenna device in accordance with claim 1, wherein the direction of the extending force and the direction of the opposing force are parallel to one another.

19. The underwater antenna device in accordance with claim 1, wherein the cable drum has a friction clutch.

* * * * *